US005614034A

United States Patent [19]

Suga et al.

[11] Patent Number: 5,614,034

[45] Date of Patent: Mar. 25, 1997

[54] PROCESS FOR PRODUCING ULTRAHIGH SILICON ELECTRICAL THIN STEEL SHEET BY COLD ROLLING

[75] Inventors: Yozo Suga; Hotaka Honma; Yoshiyuki Ushigami; Syuji Kitahara, all of Kitakyushu, Japan

[73] Assignee: Nippon Steel Corporation, Tokyo, Japan

[21] Appl. No.: 731,111

[22] Filed: Jul. 15, 1991

[30] Foreign Application Priority Data

Jul. 16, 1990 [JP] Japan ..... 2-187735

[51] Int. Cl.[6] ..... H01F 1/04

[52] U.S. Cl. ..... 148/111; 148/112

[58] Field of Search ..... 148/111, 2, 112, 148/113

[56] References Cited

U.S. PATENT DOCUMENTS 4,773,948 9/1988 Nakaoka et al. ..... 148/111

FOREIGN PATENT DOCUMENTS 229846 7/1987 European Pat. Off. .
377734 7/1990 European Pat. Off. .
2236009 1/1975 France .
54-13846 6/1979 Japan .
61-166923 7/1986 Japan .
62-103321 5/1987 Japan .
62-103326 5/1987 Japan .
62-227035 10/1987 Japan .
62-270723 11/1987 Japan .
63-36906 2/1988 Japan .
63-145716 6/1988 Japan .
63-295003 12/1988 Japan .
1299702 4/1989 Japan .
893211 4/1962 United Kingdom .
8911549 11/1989 WIPO .

OTHER PUBLICATIONS

Patent Abstracts of Japan, vol. 12, No. 25, (M-718) [3098] Jul. 15, 1988 European Search Report EP 91 11 1772 (Feb. 17, 1988).
C. A. Clark: IEE. 113 (1966) p. 345.
K. Narita : IEE. Trans. Mag. MAG-14 (1978) p. 258.
H. Kimura : Bulletin of the Japan Institute of Metals, vol. 21, No. 10, p. 757 (1982).
NKK. Technical Report No. 125, p. 58 (1989).

*Primary Examiner*—Sikyin Ip
*Attorney, Agent, or Firm*—Kenyon & Kenyon

[57] ABSTRACT

The present invention provides a thin sheet product having a combination of excellent magnetic properties inherent in the steel having a silicon content of 6.5% or near 6.5% with a further lowered iron loss property, particularly in a high frequency region, through the production of a magnetic thin steel sheet having a thickness of 0.23 mm or less by cold-rolling a steel sheet comprising by weight not more than that 0.006% of carbon, 5.0 to 7.1% of silicon, 0.07 to 0.30% of manganese, not more than 0.007% of sulfur, 0.006 to 0.038% of acid soluble aluminum and 8 to 30 ppm of total nitrogen with the balance consisting of iron and unavoidable impurities at a sheet temperature in the range of from 120° to 350° C. optionally after annealing the sheet at a temperature in the range of from 750° to 1020° C., and annealing the cold-rolled sheet at a temperature in the range of from 800° to 1020° C. for recrystallization and grain growth, to thereby prepare a magnetic steel sheet having a small thickness of 0.23 mm or less.

8 Claims, 6 Drawing Sheets

10μm (×5000)

10μm (×5000)

10μm (×5000)

10μm (×5000)

PROCESS FOR PRODUCING ULTRAHIGH SILICON ELECTRICAL THIN STEEL SHEET BY COLD ROLLING

BACKGROUND OF THE INVENTION (1) Field of the Invention

The present invention relates to a process for producing an ultrahigh silicon electrical steel sheet having an excellent magnetic property for use as a soft magnetic material in an iron core of electrical machinery and apparatuses by cold rolling, and having an excellent workability. According to the present invention, it becomes possible to produce an ultrahigh silicon electrical thin steel sheet having a small thickness best suited for use in an iron core of electrical machinery and apparatuses, particularly high-frequency electrical machinery and apparatuses.

(2) Description of the Related Art

A steel sheet containing silicon has been used as an iron core of a power transformer or rotating machine, due to its excellent soft magnetic property. In this soft magnetic material, the iron loss property improved, i.e., the iron loss value lowered, with an increase of the silicon content. In particular, when the silicon content is around 6.5%, the iron loss property is good, and further, the magnetic struction approaches zero, which contributes to a further improvement of the magnetic permeability, and thus a magnetic material having a new function not attained by the prior art can be obtained. Iron having a silicon content of 6.5%, however, has various problems in the cold working thereof, for example, cold rolling, and therefore, has not been put to practical use.

Examples of the problems encountered in the cold working of the iron having a silicon content of 6.5% include the following.

1) Due to a small elongation derived from the intrinsic property of the high silicon iron crystal, the iron is susceptible to sheet breaking during the cold rolling.
2) Due to a small elongation inherent in the high silicon iron, the iron is liable to cause cracking at an edge portion of a sheet, i.e., edge cracking, during the cold rolling.
3) Since the high silicon iron has a very high hardness, the rolling load during cold rolling becomes very high when the final thickness is small.

Recently, high silicon steel sheets having a silicon content of 6.5% or around 6.5% have been reconsidered as energy saving or as novel magnetic steel sheets capable of meeting various magnetic property requirements of electrical machinery and apparatuses. In particular, a great effort has been made to solve the problem of cold rolling, and this has led to various proposals. For example, in connection with the problem of the high susceptibility of the high silicon iron to sheet breaking described in the above item 1), Nakaoka et al. proposed in Japanese Unexamined Patent Publication (Kokai) No. 61-166923 a method wherein continuous finish hot rolling conditions are specified on a hot rolled sheet used as a material for cold rolling, to thus form a metallic structure extending in a fibrous form to the rolling direction. Nakaoka et al. proposed in Japanese Unexamined Patent Publication (Kokai) No. 62-103321 a method wherein a metallic structure in a fibrous form stretched in the rolling direction is formed by determining a crystal grain size of a material before a continuous finish hot rolling. In these methods, the hot rolled sheet structure is controlled by determining the continuous finish hot rolling conditions, and the cold rolling is made possible through the use of the resulting hot rolled sheet as a starting material.

Alloying of an iron having a silicon content of 6.5% with a third element has been reported as a method of improving the cold rollability. For example, C. A. Clark et al. reported in IEE., 113 (1966) p. 345, an effected attained by an addition of nickel, and K. Narita et al. has reported in IEEE Trans. Mag. MAG-14 (1978) p. 258 an effect attained by an addition of manganese.

Further, Kimura et al. disclosed in Japanese Unexamined Patent Publication (Kokai) No. 1-299702 a method and an apparatus for carrying out rolling at a temperature of 350° to 450° C. The conventional cold a rolling technique, however, cannot cope with the above-described temperature range.

The problem of edge cracking described in the above item 2) can be solved by a method capable of solving the problem described in the above item 1). Further, to prevent edge cracking, a more careful application of a method generally used in other types of steels is useful also for a cold rolling of a high silicon steel. For example, Masuda et al. proposed in Japanese Unexamined Patent Publication (Kokai) No. 62-295003 to prevent edge cracking through a control of a heat crown at the roll end portion.

The problem of an excessive rolling load described in the above item 3) is such that the hardness (Hv) of steel increases with an increase in the silicon content and, for example, reaches 390 when the silicon content is 6.5%, so that the cold rolling load becomes too high. The thinner the rolling thickness, the larger the rolling load. In general, when the diameter of the rolling rolls is reduced, the contact arc length between the rolls and the rolling material becomes small, which enables a sheet material to be rolled under a low load. For this reason, a Sendzimir mill provided with working rolls having a diameter of 100 mm or less has been used for the cold rolling of a grain-oriented magnetic steel sheet or non-oriented magnetic steel sheet having a silicon content of about 3%. Therefore, obviously a rolling by a rolling machine provided with working rolls having a smaller diameter is necessary for the cold rolling of a material having a silicon content of 6.5%, i.e., a material having a much higher hardness than that of the material having a silicon content of 3%, to a thin thickness. In the cold rolling of the material having a silicon content of 6.5% by a rolling machine provided with work rolls having a small diameter, however, a problem of strip breaking arises, as reported by Takada et al. in Japanese Unexamined Patent Publication (Kokai) No. 63-145716.

For this reason, the solution of the problem described in the above item 1) becomes necessary also for a rolling of the high silicon material by a rolling machine provided with working rolls having a small diameter.

The magnetic properties of a high silicon iron will now be described.

A motive for the development of a high silicon soft magnetic steel sheet resides in the realization of high functions not attained by the prior art, for example, iron loss property and magnetizing property, although the difficulty of production has fully been recognized in the art. Therefore, although it is obvious that attention should be paid to an ease of production, particularly the ease of cold rolling, it is necessary to design the manufacturing process while making the first aim the production of a product having good magnetic properties. In this respect, no satisfactory technique has been established on the process for producing a high silicon soft magnetic steel sheet, especially imparting an optimal magnetic property to a material having a silicon content of 6.5% wherein the magnetic striction becomes minimum. In particular, a reduction of the iron loss in a thin product is essential to a material exhibiting an advantage in a high frequency region, such as a steel having a silicon content of 6.5%, and the worth of this means is halved in the production of a steel having a silicon content of 6.5%, at which is impossible to produce a thin product. For example, Abe et al. avoided, in Japanese Unexamined Patent Publication (Kokai) No. 62-227035, the problem of the cold rolling by a process wherein siliconizing is conducted in an atmosphere containing $SiCl_4$, i.e., by the CVD process, and produced a product having a thickness of 0.10 mm; see NKK Technical Report, No. 125, 58 (1989). In the CVD process, however, problems remain unsolved with regard to the productivity and accuracy of the sheet thickness, and the development of a novel manufacturing process by the cold rolling is desired in the art. Note, Japanese Unexamined Patent Publication (Kokai) No. 62-270723 discloses a product having a thickness of 0.30 mm, and Japanese Unexamined Patent Publication (Kokai) No. 61-166923 discloses a product having a thickness of 0.50 mm. Further, also in the above-described report, which describes the effect of the component per se, the thickness of the product disclosed is as thick as 0.35 mm. This thickness is unsatisfactory for a sufficient exhibition of the advantage of the magnetic property of the steel having a silicon content of 6.5%.

It is known in the art that a material having a poor workability is rolled at an elevated rolling temperature, i.e., by a warm rolling. In the steel also having a silicon content of 6.5%, the warm rolling is less susceptible to cracking, i.e., more effective than the room temperature rolling. The warm rolling, however, has problems such as a heat resistance of rolling lubricants, a necessity to provide new equipment for ensuring the rolling temperature, and a difficulty of regulating the sheet thickness accompanying the variation in the sheet temperature in the widthwise direction and longitudinal direction of the sheet. Therefore, the warm rolling cannot be adopted as such. For example, Japanese Unexamined Patent Publication (Kokai) No. 1-299702 discloses a method and equipment for conducting rolling at a temperature of 350° to 400° C. In this method, a material is rolled to a thickness of 0.2 to 0.4 mm. Japanese Unexamined Patent Publication (Kokai) No. 63-36906 discloses that a material is rolled at 350° C. to a thickness of 0.35 mm. In the field of the production of a grain oriented electrical steel sheet having a silicon content of about 3%, Japanese Examined Patent Publication (Kokoku) No. 54-13846 discloses that the magnetic property is improved by maintaining the material at a temperature of 50° to 350° C. for one min or longer, in between passes of the rolling. In an embodiment, a reverse rolling is conducted at an elevated sheet temperature. In general, the rolling at a sheet temperature of about 250° C. is widely conducted for avoiding the above-described problems such as lubrication and uneven sheet temperature.

SUMMARY OF THE INVENTION

Under the above-described circumferences, the present inventors have studied the composition of a steel having a silicon content of 6.5% cold-rollable to a small sheet thickness not attainable by the prior art through rolling at a sheet temperature not above the temperature used in the production of a grain oriented electrical steel sheet, and have studied the effect of constituents, and further, conducted many test rollings on an optimal combination of all the constituents, and as a result, have made a limitation such that the composition of the steel material intended in the present invention comprises by weight not more than 0.006% of carbon, 5.0 to 7.1% of silicon, 0.07 to 0.30% of manganese, not more than 0.007% of sulfur, 0.006 to 0.038% of acid soluble aluminum and 8 to 30 ppm of total nitrogen, with the balance consisting of iron and unavoidable impurities.

The steel sheet comprising the above-described composition is optionally annealed at a temperature of 750° to 1020° C., cold-rolled at a sheet temperature of 120° to 350° C., annealed for recrystallization and grain growth at a temperature of 800° to 1020° C. to prepare an electrical steel sheet.

Accordingly, the present invention provides a process for producing an ultrahigh silicon electrical thin steel sheet which enables a thin sheet product having a combination of excellent magnetic properties inherent in the steel having a silicon content of 6.5% or near 6.5% with a further lowered iron loss property, particularly in a high frequency region, to be produced by the conventional cold rolling process.

DESCRIPTION OF THE PREFERRED EMBODIMENTS

The constitution of the present invention will now be described.

At the outset, with respect to the relationship between the material ingredients and the cracking, Japanese Unexamined Patent Publication (Kokai) No. 62-103321 describes that, in general, the composition preferably comprises not more than 0.5% of manganese, not more than 0.1% of phosphorus, not more than 0.02% of sulfur, not more than 2% of aluminum and not more than 1% of carbon. This is also accepted as a general tendency in common steel and does not particularly show a novel finding on a steel having a silicon content of 6.5%. Further, this suggests only upper limits of the contents of individual components, and does not specify the requirements for components of a steel having a silicon content of 6.5%.

It is known that the toughness increases with a reducing of the nitrogen content of the steel, but in a commercial refining technique, the nitrogen content could be lowered to 8 ppm at most, even in the field of an advanced refining technique as disclosed in Japanese Unexamined Patent Publication (Kokai) No. 62-103326. The influence of nitrogen described by Hiroshi Kimura in Bulletin of the Japan Institute of Metals, Vol. 21, No. 10, p. 757 is that where the nitrogen content is lowered to several ppm by a special treatment. On the other hand, the present inventors aim at a technique which enables a steel having a silicon content of 6.5% to be rolled to a small thickness through the use of a material having a nitrogen content of 8 ppm or more obtained by a general refining technique on a commercial scale.

Under the above-described circumstances, the present inventors have studied the influence of nitrogen in the steel on rolling cracking of a steel having a silicon content of 6.5%, and as a result, have found an aluminum content suitable for reducing this rolling cracking. Further, they have perceived that the form of nitrogen in the steel sheet before rolling at that time is related to the cracking.

Figure 1:
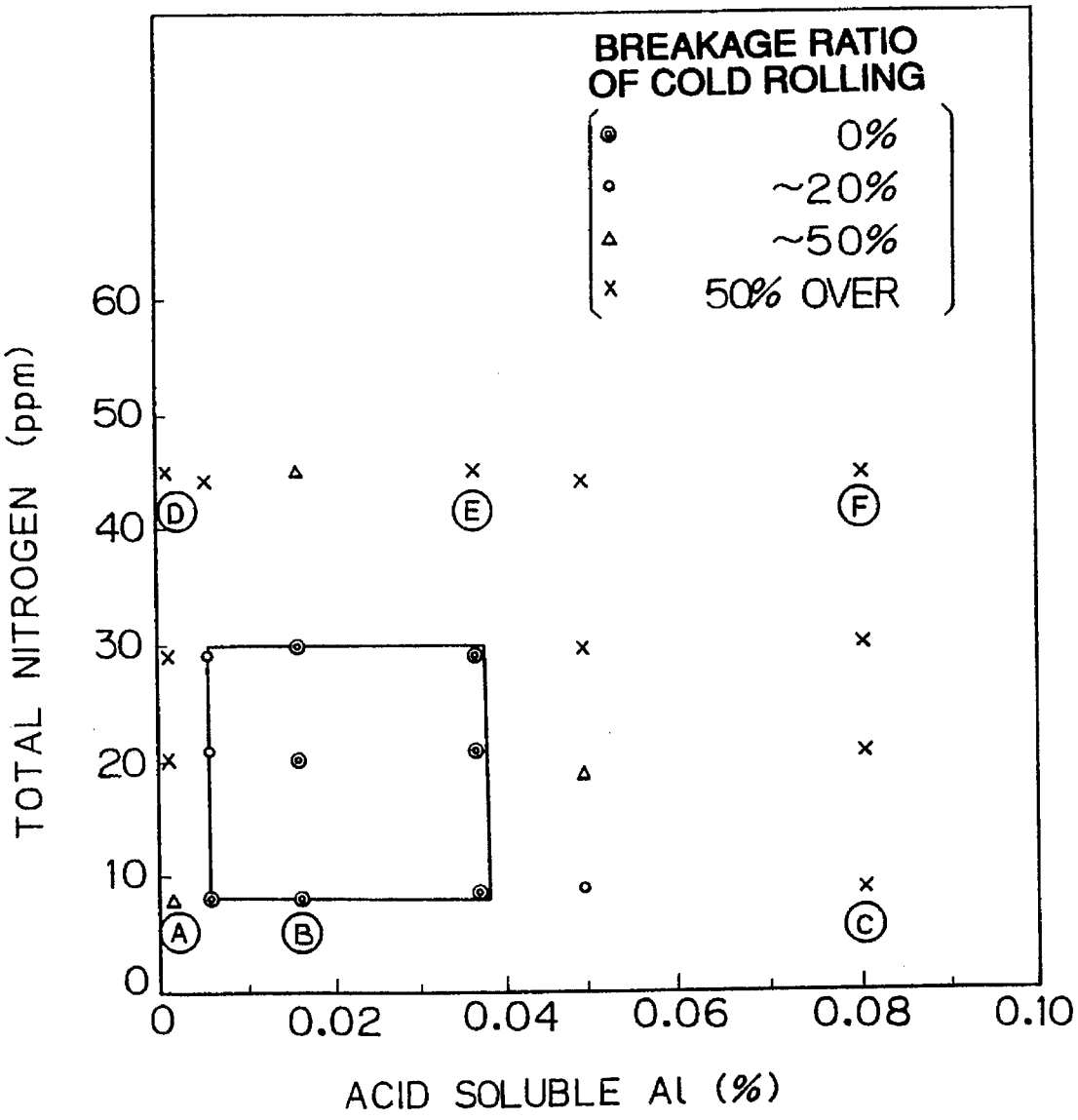
FIG. 1 is a diagram showing the cold rolling breakage of steel sheets having a different from each other in the content of total nitrogen and acid soluble aluminum in the steel.
Figure 2A:
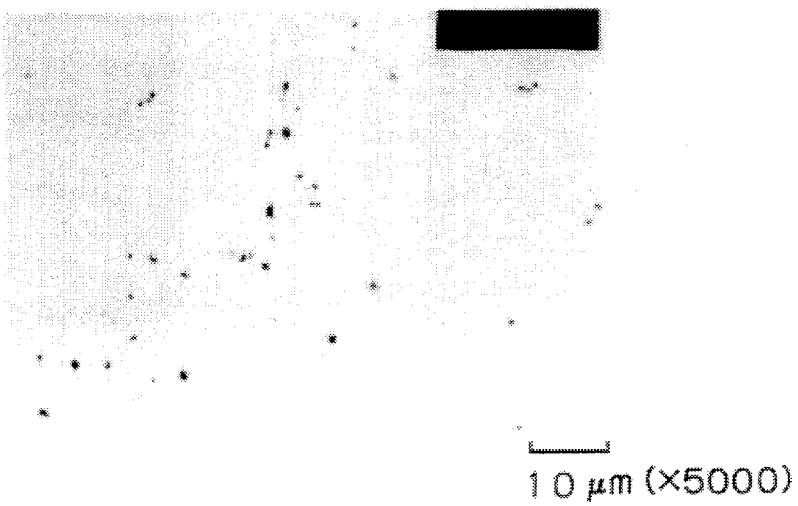
FIG. 2(A) is an electron photomicrograph showing the state of precipitates in the hot rolled sheet for material (A) of FIG. 1.
Figure 2B:
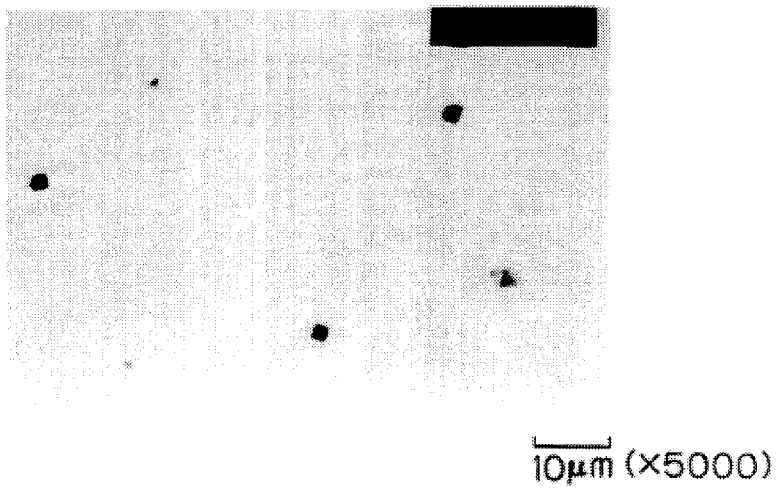
FIG. 2(B) is an electron photomicrograph showing the state of precipitates in the hot rolled sheet for material (B) of FIG. 1.
Figure 2C:
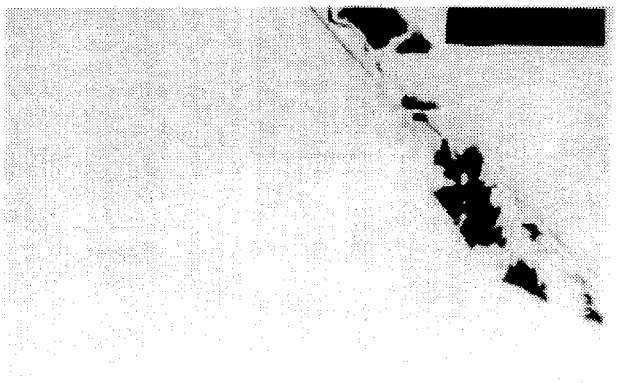
FIG. 2(C) is an electron photomicrograph showing the state of precipitates in the hot rolled sheet for material (C) of FIG. 1.
Figure 2D:
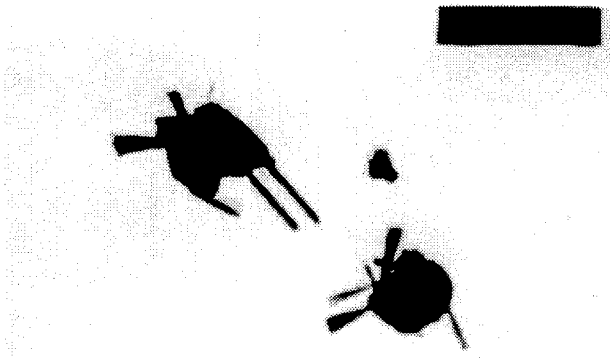
FIG. 2(D) is an electron photomicrograph showing the state of precipitates in the hot rolled sheet for material (D) of FIG. 1.
Figure 2E:
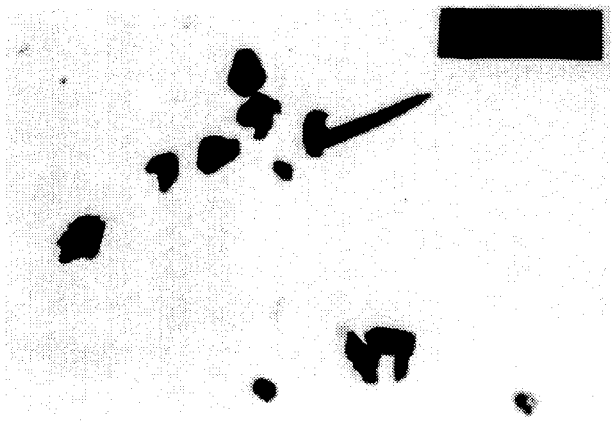
FIG. 2(E) is an electron photomicrograph showing the state of precipitates in the hot rolled sheet for material (E) of FIG. 1.
Figure 2F:
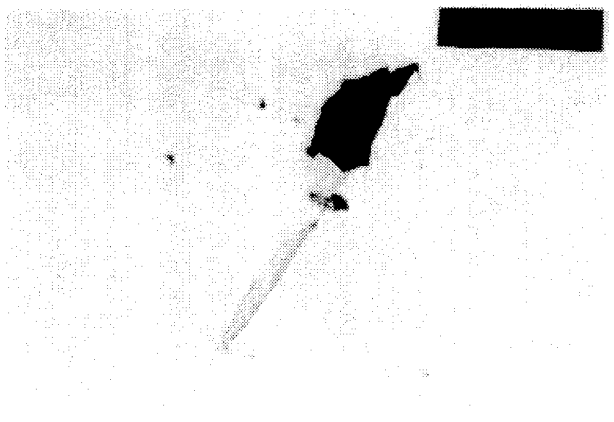
FIG. 2(F) is an electron photomicrograph showing the state of precipitates in the hot rolled sheet for material (F) of FIG. 1.

First there was prepared a 50 kg of an ingot comprising 0.005% of carbon, 6.50% of silicon, 0.17% of manganese, 0.007% of phosphorus and 0.002% of sulfur, and having a relationship between acid soluble aluminum and nitrogen as shown in FIG. 1. The ingot was heated at 1200° C. and subjected to 8 passes of hot working with a finishing temperature of about 980° C. to prepare a steel sheet having a thickness of 1.7 mm, and 10 sheets having a size of 5 cm in width×12 cm in length were prepared from each composition material. The sheets were cold-rolled at a sheet temperature of 180° C. to a thickness of 0.23 mm, and the sheet breaking caused at that time is shown in FIG. 1. As apparent from FIG. 1, the cold rolling breakage decreases with a reducing of the total nitrogen content, and increases when the acid soluble aluminum content is too high or too low. A good cold rolling was conducted when the total nitrogen was 8 ppm (a material having a nitrogen content below 8 ppm could not be obtained under general dissolving conditions) to 30 ppm and the acid soluble aluminum content was 0.006 to 0.038%. The present inventors considered that the above-described results were related to the morphology of nitrogen in the steel, and extruded replicas of hot rolled sheets as the cold rolling material were prepared on materials Ⓐ to Ⓕ shown in FIG. 1. These replicas was observed under an electron microscope, and the results are shown in FIG. 2. The precipitate of material Ⓑ free from edge cracking was relatively large and homogeneously distributed. In contrast, the precipitates of materials Ⓓ, Ⓔ and Ⓕ having a high total nitrogen content and material Ⓒ having a high acid soluble aluminum content were very large and present particularly in the grain boundary The precipitate of material Ⓐ having a low total nitrogen content and a low acid soluble aluminum content was small and dispersed in an agglomerated form. The relationship between the state of the precipitate in the steel and the mechanical properties has been extensively studied, and from this relationship, it can be generally considered that the presence of a very large precipitate, particularly in the grain boundary, in the case of materials Ⓓ, Ⓔ, Ⓕ and Ⓒ is the cause of a fragility due to the notch effect, and the presence of fine precipitate in the case of material Ⓐ, causes the strength to be increased and the elongation decreased. As described above, the present inventors have found that even a steel having a silicon content of 6.5% can be cold-rolled to a small thickness of 0.23 mm through the selection of a proper combination of the total nitrogen content with the acid soluble aluminum. Further, they have reached a conclusion that the precipitate of the material falling within the scope of the composition range is in a dispersed state, which does not accelerate the cracking.

Figure 3:
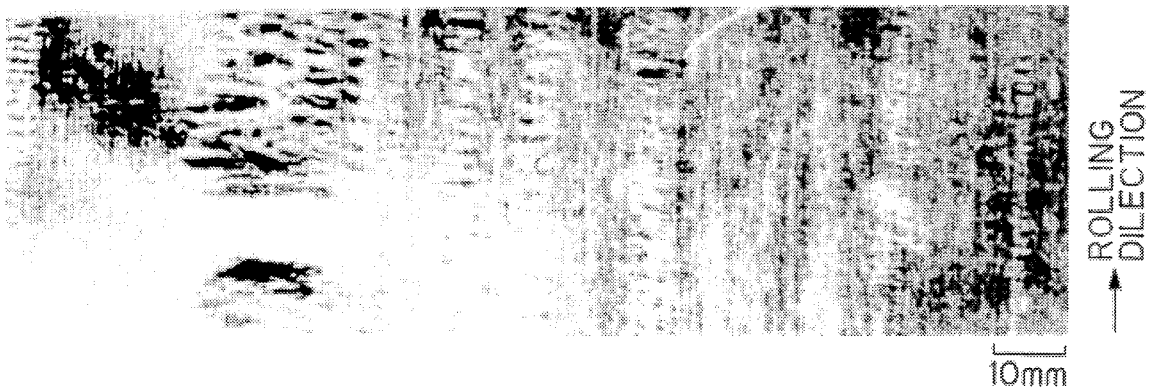
FIG. 3 is a photograph of a metallic structure showing a pattern of a "ripple defect" generated on the surface of a cold-rolled sheet.
Figure 4:
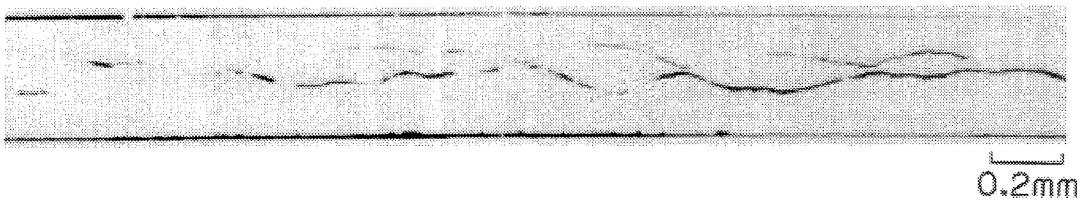
FIG. 4 is a photograph of a metallic structure in the longitudinal section (in the thickness direction of the sheet) of the cold-rolled sheet shown in FIG. 3.
Figure 5:
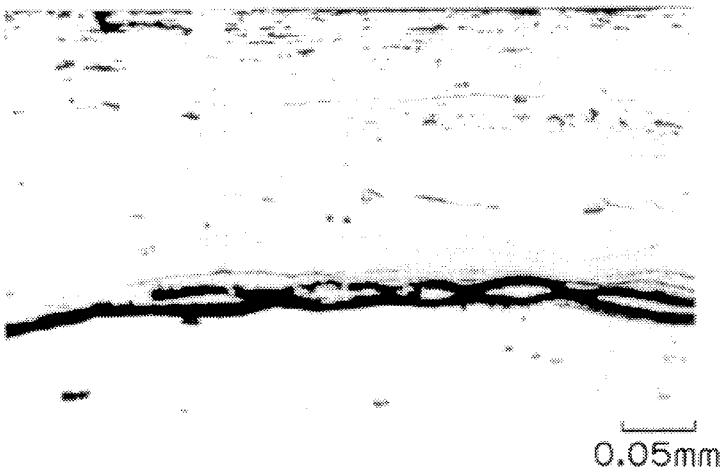
FIG. 5 is an enlarged photograph of a metallic structure of a portion having a crack in the thickness direction of the sheet material.

The present inventors have found that, when the non-defective materials are further cold-rolled to a smaller thickness, blistering in a crack form as shown in FIG. 3 occurs on the surface of the sheet and leads to breaking. Such a defect will be hereinafter referred to as a "ripple defect". The structure of section of the "ripple defect" portion in the thickness direction (longitudinal section) of the sheet is shown in FIG. 4. As apparent from FIG. 4, the cracking advances towards the center with the peaks of cracks existing at a position about ⅓ from the top and a position about ⅓ from the bottom in the thickness direction of the sheet, and this pattern is repeated. Further, when initial cracking is observed, it is apparent that the starting point of the cracking is located at a position about ⅓ from the top and a position about ⅓ from the bottom in the thickness direction of the sheet. This position corresponds to the boundary between uniaxial crystal grains present on the surface layer in the material before cold rolling and elongated grains arranged in a fibrous from in the rolling direction in the center portion of the thickness direction of the sheet. The cracked portion was corroded to expose the structure, and an enlarged photograph thereof is shown in FIG. 5. As is apparent from FIG. 5, cracking occurs at the boundary between uniaxial crystal grains present on the surface layer in the material before cold rolling and elongated grains arranged in a fibrous form in the rolling direction in the center portion of the thickness direction of the sheet. From the above-described observations, the "ripple defect" is believed to be formed as follows. Cracking occurs due to the difference in the resistance to the shear force acted on the breaking face accompanying the cold rolling between uniaxial crystal grains present on the surface layer in the material before cold rolling and elongated grains arranged in a fibrous form in the rolling direction in the center portion of the thickness direction of the sheet, and the cracks propagate through the center in the thickness direction of the sheet. Based on the above-described knowledge, the present inventors have found that the homogenization of crystal grains in the thickness direction of the sheet is most important to an improvement in the cold rollability without causing the "ripple defect".

Accordingly, the present inventors conducted annealing for recrystallizing crystal grains all over the area, and a proper temperature range for the annealing was determined.

Figure 6:
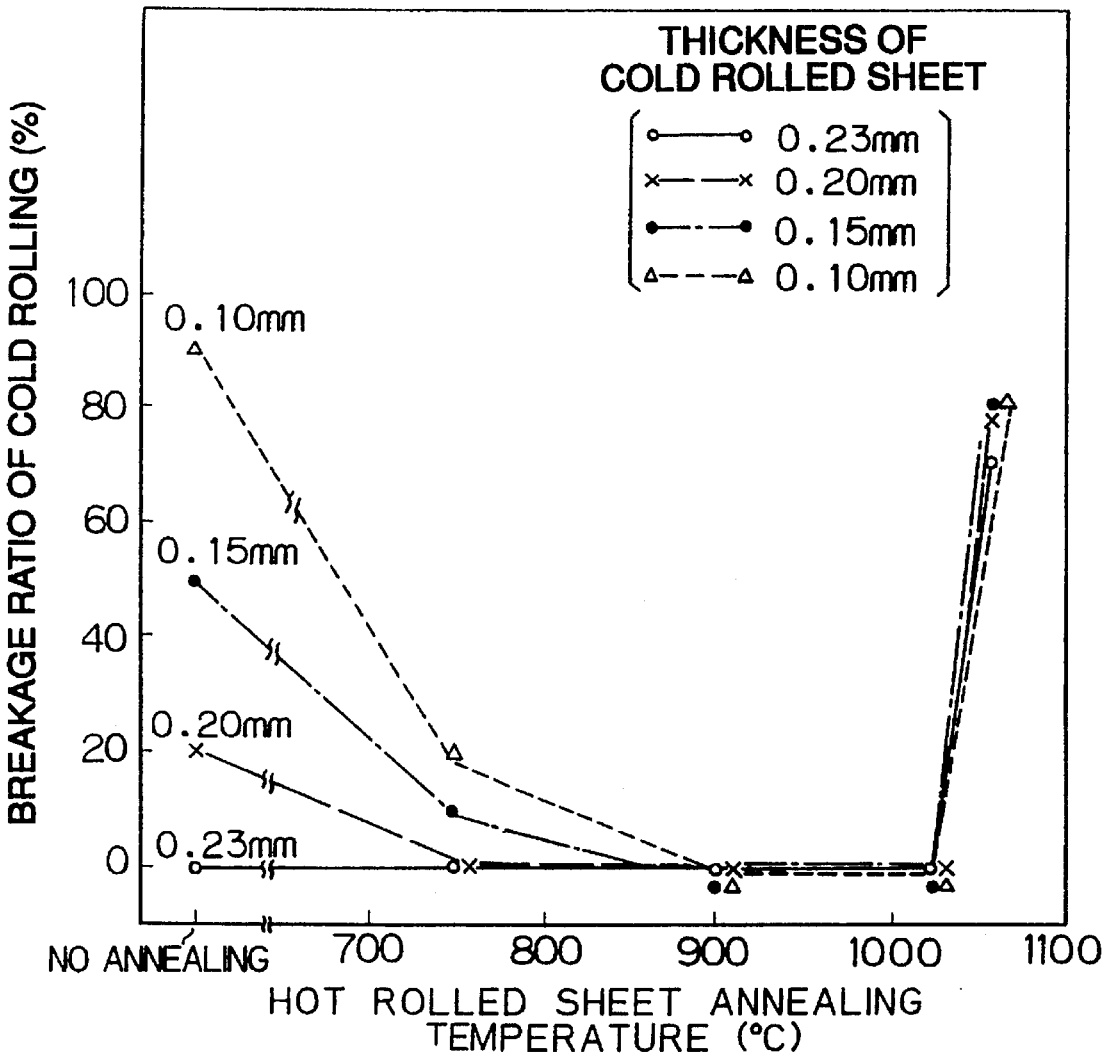
FIG. 6 is a graph showing the relationship between the cold rolling breakage and the hot rolled sheet annealing temperature with respect to cold rolled steel sheets with various thicknesses.

With respect to the hot-rolled sheet B shown in FIG. 1, 50 sheets having a size of 5 cm in width×12 cm in length were prepared. Four sheet groups each comprising 10 sheets were annealed for 90 sec at 750° C., 900° C., 1020° C. and 1080° C., respectively, and the remaining 10 sheets was not annealed. The sheets were then cold-rolled at a sheet temperature of 180° C. to a thickness of 0.23 mm. The sheets which had not broken by the cold rolling was further rolled to thicknesses of 0.20 mm, 0.15 mm and 0.10 mm to determine sheet breakage (%), and the results are shown in FIG. 6. When no annealing of the hot rolled sheet was conducted, the breakage increased with reducing the thickness of the cold rolled sheet. The annealing of the hot rolled sheet prevented the occurrence of breaking, and no breaking occurred even when the thickness was 0.10 mm. When the temperature is excessively high, however, breaking occurs in the rolling of the sheet even to a thickness of not less than 0.23 mm. This is believed to because, when the annealing temperature is excessively high, the size of crystal grains becomes so large that the toughness deteriorates.

The limitation in embodiments of the present invention will now be described.

When carbon remains as an impurity in a final product, it deteriorates the magnetic properties of the product. Therefore, the carbon content is preferably as low as possible. In particular, when the carbon content exceeds 0.006%, the magnetic properties are greatly deteriorated. Also, from the viewpoint of the cold rollability, the lower the carbon content, the better the results obtained.

In view of the fact that the object of the present invention is to establish a process which enables a thin product having a silicon content of about 6.5% capable of minimizing the magnetic strain to be produced on a commercial scale, the silicon content may be within a range where 6.5% is the center thereof. The lower limit of the silicon content is 5.0% because no material having a silicon content lower than 5.0% is commercially available, and the silicon content is preferably a value close to 6.5% as much as possible. The upper limit of the silicon content is 7.1%. When the silicon content exceeds about 6.5%, the cold workability rapidly deteriorates and no improvement in the magnetic properties can be attained.

When the manganese content is in the range of from 0.07 to 0.3%, the sheet breakage in cold rolling is low, and in particular, a significant effect can be attained in a small sheet thickness of 0.20 mm or less.

The lower the sulfur content, the better the cold workability and the less the susceptibility of the final product to deterioration of the magnetic properties attributable to the remaining of the sulfur in the final product. Therefore, the sulfur content is preferably as low as possible. For this reason, it is limited to 0.007% or less. The lower limit is preferably as low as possible but is about 0.0008% from the viewpoint of the limitation of current general industrial refining technique.

With respect to acid soluble aluminum and total nitrogen, a combination of an acid soluble aluminum content of 0.006 to 0.038% with a total nitrogen content of 8 to 30 ppm provides a good cold rollability. The reason for this is believed to reside in that when the contents of acid soluble aluminum and total nitrogen are in the above-described respective ranges, the total nitrogen contained in the steel is in a precipitate form which does not deteriorate the toughness of the steel.

There is no particular limitation on the components other than described above.

Then, the molten steel is cast and hot-rolled. In the present invention, there is no particular limitation on casting conditions, and the conventional procedure may be used. In the present invention, use may be made of a thin sheet produced by thin sheet casting developed as a casting technique in recent years, i.e., a process which comprises conducting casting to prepare a sheet having a thickness of about 2.0 mm and either omitting a step of hot rolling or applying to the sheet such a small pressure that the shape can be corrected, thereby directly preparing a material for cold rolling. The steel sheet prepared by the thin sheet casting process, however, has a slightly poor cold rollability because the size of crystal grains is large.

The hot rolled sheet or cast thin sheet is cold-rolled at a sheet temperature of 120° to 350° C. When the sheet temperature exceeds 350° C., the rolling lubricant remarkably deteriorates, so that the rolling becomes very difficult, and further, the control of the sheet becomes difficult. In the rolling, the sheet temperature may be in the above-described range, and no residence time is basically necessary. Annealing at a temperature in the range of from 750° to 1020° C. for recrystallization all over the area in the thickness direction of the sheet as a step prior to the cold rolling eliminates the occurrence of the "ripple defect" during cold rolling and consequently reduces the breaking in cold rolling, so that it is possible to conduct rolling to a smaller thickness. When the annealing temperature is below 750° C., some nonrecrystallized region remains in the center portion of the sheet thickness, so that the annealing makes no sense. On the other hand, when the annealing temperature exceeds 1020° C., since crystal grains becomes coarse, breaking occurs before the occurrence of the ripple defect. When the annealing temperature is high, the annealing time is short, while when the annealing temperature is low, the annealing time is long. For example, the annealing time may be 10 min or more when the annealing temperature is 750° C. and about 30 sec when the annealing temperature is 1020° C.

The smaller the thickness of the sheet obtained in the cold rolling, the better the iron loss, but the rolling load increases with a reducing of the sheet thickness in the cold rolling, and this makes it difficult to conduct the rolling work. For this reason, a useful method is that wherein the diameter of the rolling rolls is reduced and the rolling is conducted in a multi-stage, or alternatively, the annealing is conducted in the course of rolling to recrystallize crystal grains, thus softening the sheet.

There is no particular limitation on reduction in the cold rolling. The reduction depends upon the capacity of a hot rolling machine or the relationship between the material sheet thickness and the product sheet thickness determined by the level of the thin sheet casting technique. The percentage cold rolling is preferably about 50 to 80% because the magnetic flux density of the resulting product becomes high. When a thin sheet product is desired, however, use should be made of a thin material sheet for the cold rolling with the above-described percentage cold rolling. Therefore, when the desired product sheet thickness is very small, the current hot rolling technique cannot cope with the thickness. Specifically, the lower limit of the thickness of the hot rolled sheet attainable by the existing hot rolling technique is about 1.4 to 1.5 mm. When the production of an ultrathin sheet product in a single cold rolling is intended, the percentage cold rolling falling within the above-described range cannot be obtained, which often causes the magnetic flux density of the product to be slightly lowered. Nevertheless, since the primary object of the present invention is to produce an ultrahigh silicon magnetic thin steel sheet through cold rolling, the above-described percentage cold rolling is not essential to the present invention.

The sheet cold-rolled to a final thickness is annealed at a temperature in the range of from 800° to 1020° C. and then subjected to recrystallization and grain growth to prepare a product. The annealing time is long when the annealing temperature is low and short when the annealing temperature is high, and is usually about 30 sec to 3 hr.

According to the present invention, a steel having a silicon content of about 6.5% which is difficult to work can be worked to a very small thickness by the conventional cold rolling, and the resultant sheet has a low iron loss, particularly an excellent iron loss value at a high frequency.

EXAMPLES

Example 1

A 50 kg ingot comprising carbon, silicon, manganese, sulfur and acid soluble aluminum in respective amounts given in Table 1 with the balance consisting of iron and unavoidable impurities was prepared. The ingot was heated at 1200° C. and subjected to hot working of 8 passes with a finishing temperature of about 990° C. to prepare a steel sheet having a thickness of 1.8 mm, and 10 sheets having a size of 5 cm in width×12 cm in length were prepared from each composition material. The sheets were cold-rolled at a sheet temperature of 180° C. to a thickness of 0.23 mm, and the sheets were then annealed at 850° C. for 120 sec. The sheet breakage upon cold rolling at that time is given in Table 1.

As apparent from Table 1, the steel sheet which meets component requirements specified in the present invention can be rolled to a thickness of 0.23 mm without significant breaking during cold rolling.

TABLE 1

| Sample | Component (%) | | | | | | Breakage in cold rolling (%) | | | |
|---|---|---|---|---|---|---|---|---|---|---|
| No. | C | Si | Mn | S | acid soluble aluminum | total nitrogen | 0.35 mm | 0.23 mm | 0.20 mm | Remarks |
| 1 | 0.004 | 6.52 | 0.13 | 0.001 | 0.025 | 0.0015 | 0 | 0 | 20 | present invention |
| 2 | 0.025 X | 6.52 | 0.13 | 0.001 | 0.025 | 0.0015 | 50 | 100 | 100 | comparative |
| 3 | 0.003 | 6.53 | 0.03 X | 0.001 | 0.023 | 0.0013 | 30 | 50 | 100 | comparative |
| 4 | 0.003 | 6.53 | 0.50 X | 0.001 | 0.023 | 0.0012 | 20 | 40 | 90 | comparative |
| 5 | 0.004 | 6.52 | 0.13 | 0.015 X | 0.027 | 0.0014 | 30 | 50 | 70 | comparative |
| 6 | 0.004 | 6.52 | 0.13 | 0.001 | 0.001 X | 0.0013 | 40 | 50 | 70 | comparative |
| 7 | 0.004 | 6.52 | 0.13 | 0.001 | 0.050 X | 0.0012 | 30 | 50 | 60 | comparative |
| 8 | 0.004 | 6.52 | 0.13 | 0.001 | 0.047 X | 0.0042 X | 70 | 70 | 90 | comparative |
| 9 | 0.004 | 6.52 | 0.13 | 0.001 | 0.026 | 0.0047 X | 50 | 60 | 70 | comparative |
| 10 | 0.004 | 6.52 | 0.13 | 0.001 | 0.050 X | 0.0047 X | 80 | 90 | 100 | comparative |
| 11 | 0.004 | 6.52 | 0.13 | 0.001 | 0.0010 | 0.0047 X | 70 | 80 | 90 | comparative |

Note:
X: outside the scope of the present invention.

Example 2

With respect to sample 1 described in Example 1, 40 sheets having a size of 5 cm in width×12 cm in length were prepared. Among them, 10 sheets were not annealed. The remaining three sheet groups each comprising 10 sheets were annealed at 750° C. for 15 min, at 930° C. for 90 sec and 1050° C. for 30 sec, respectively. Therefore, the sheets were cold-rolled at 220° C. to thicknesses of 0.20 mm and 0.15 mm and then annealed at 850° C. for 120 sec. The breakage in cold rolling at that time is given in Table 2.

TABLE 2

| Annealing of hot rolled sheet | Breakage in cold rolling 0.20 mm | 0.15 mm |
|---|---|---|
| None | 20 | 70 |
| 750° C. × 15 min | 10 | 20 |
| 930° C. × 90 sec | 0 | 0 |
| 1050° C. × 30 sec | 70 | 80 |

As apparent from Table 2, annealing at an appropriate temperature enables the sheet to be cold-rolled to a small thickness without breaking, compared with the case where no annealing of the hot rolled sheet was conducted. When the annealing temperature is excessively high, a remarkable breaking occurs even when the sheet thickness in cold rolling is thick.

Example 3

The 0.15 mm-thick cold-rolled sheet (annealing temperature of the hot-rolled sheet: 930° C. for 90 sec) prepared in Example 2 was annealed at 900° C. for 90 sec for recrystallization, thereby softening the sheet. The sheet was then cold-rolled at room temperature (about 27° C.) to a thickness of 0.08 mm without breaking by means of a rolling machine having a roll diameter of 140 mm. Thereafter, annealing was conducted at 850° C. for 2 hr. The magnetic properties of the resultant product are given in Table 3. As is apparent from Table 3, when the sheet is softened by annealing in the course of cold rolling, it becomes possible to conduct rolling to a very small thickness even by means of a rolling machine having a relatively large roll diameter, and the resultant product has superior magnetic properties.

TABLE 3

| $B_8$ (T) | $B_{25}$ (T) | $W_{10/50}$ (W/kg) | $W_{10/400}$ (W/kg) | $W_{10/1k}$ (W/kg) |
|---|---|---|---|---|
| 1.28 | 1.39 | 0.70 | 7.0 | 17.5 |

Example 4

A 1.8 mm-thick hot rolled sheet comprising by weight 0.003% of carbon, 6.48% of silicon, 0.14% of manganese, 0.001% of sulfur, 0.035% of acid soluble aluminum and 0.0012% of total nitrogen with the balance consisting of iron and unavoidable impurities was annealed at 980° C. for 30 sec, rolled at a sheet temperature of 230° C. to a thickness of 0.90 mm (reduction ratio of cold rolling: 50%) to 0.20 mm (reduction ratio of cold rolling: 89%) and then annealed at 850° C. for 120 sec.

The magnetic properties of the resultant products are given in Table 4 together with the reduction ratio of cold rolling.

TABLE 4

| Cold rolled sheet | | Magnetic flux density $B_8$ (T) | | |
|---|---|---|---|---|
| sheet thickness | reduction ratio of cold rolling | cold rolling direction (L) | normal direction (C) | average $\left(\frac{L+C}{2}\right)$ |
| 0.90 mm | 50% | 1.41 T | 1.36 T | 1.385 T |
| 0.75 mm | 58% | 1.43 T | 1.37 T | 1.400 T |
| 0.65 mm | 64% | 1.43 T | 1.37 T | 1.400 T |
| 0.50 mm | 72% | 1.46 T | 1.38 T | 1.420 T |
| 0.45 mm | 75% | 1.47 T | 1.39 T | 1.430 T |
| 0.35 mm | 81% | 1.40 T | 1.36 T | 1.380 T |
| 0.28 mm | 84% | 1.40 T | 1.35 T | 1.375 T |
| 0.23 mm | 87% | 1.39 T | 1.35 T | 1.370 T |
| 0.20 mm | 89% | 1.38 T | 1.34 T | 1.360 T |

As apparent from Table 4, the magnetic density ($B_8$ value) of the product reaches maximum when the reduction ratio of cold rolling is 72 to 75%, the $B_8$ value is relatively high when the reduction ratio of cold rolling is 50 to 80%, and the $B_8$ value becomes low when the reduction ratio of cold rolling exceeds 80%.

We claim:

1. A process for producing an ultra high silicon electrical thin steel sheet by cold rolling, which comprises cold-rolling a steel sheet consisting essentially of by weight not more than 0.006% of carbon, 5.0 to 7.1% of silicon, 0.07 to 0.30% of manganese, not more than 0.007% of sulfur, 0.006 to 0.038% of acid soluble aluminium and 8 to 30 ppm of total nitrogen with the balance consisting of iron and unavoidable impurities at a sheet temperature in the range of from 120° to 350° C., said steel sheet being cold rolled to a thickness of 0.23 mm or less, and annealing the cold-rolled sheet for recrystallization and grain growth.

2. A process according to claim 1, wherein said steel sheet is annealed at a temperature in the range of from 750° to 1020° C. before said cold rolling.

3. A process according to claim 1, wherein said steel sheet is a hot rolled sheet.

4. A process according to claim 2, wherein said steel sheet is a hot rolled sheet.

5. A process according to claim 1, wherein said steel sheet is a continuous cast piece.

6. A process according to claim 2, wherein said steel sheet is a continuous cast piece.

7. A process according to claim 1, wherein said annealing after the cold rolling is carried out at a temperature in the range of from 800° to 1020° C.

8. A process according to claim 2, wherein said annealing after the cold rolling is carried out at a temperature in the range of from 800° to 1020° C.

* * * * *

UNITED STATES PATENT AND TRADEMARK OFFICE

CERTIFICATE OF CORRECTION

PATENT NO. : 5,614,034

DATED : March 25, 1997

INVENTOR(S) : Yozo SUGA, et al.

It is certified that error appears in the above-indentified patent and that said Letters Patent is hereby corrected as shown below:

Column 2, line 6, change "effected" to --effect--.

Column 3, line 57, change "circumferences" to --circumstances--.

Column 4, line 22, change "different" to --difference--.

Column 5, line 54, change "was" to --were--.

Column 6, line 31, change "from" to --form--.

Column 6, line 42, change "acted" to --acting--.

Column 6, line 62, change "was" to --were--.

Column 6, line 65, change "was" to --were--.

Column 7, line 8, after "to" insert --occur--.

Column 10, line 4, after "rolling" insert --(%)--.

UNITED STATES PATENT AND TRADEMARK OFFICE

CERTIFICATE OF CORRECTION

PATENT NO. : 5,614,034

DATED : March 25, 1997

INVENTOR(S) : Yozo SUGA, et al.

It is certified that error appears in the above-indentified patent and that said Letters Patent is hereby corrected as shown below:

Column 12, line 10, change "of by weight" to --by weight of--.

Signed and Sealed this

Thirtieth Day of September, 1997

*Attest:*

*Attesting Officer*

BRUCE LEHMAN

*Commissioner of Patents and Trademarks*